US010590650B2

(12) United States Patent
Curd et al.

(10) Patent No.: US 10,590,650 B2
(45) Date of Patent: Mar. 17, 2020

(54) ARCH HAVING AN INTERNAL TENSION MEMBER

(71) Applicants: Robert Curd, Winchester, VA (US); George R. Register, III, Atlantic Beach, FL (US)

(72) Inventors: Robert Curd, Winchester, VA (US); George R. Register, III, Atlantic Beach, FL (US)

( * ) Notice: Subject to any disclaimer, the term of this patent is extended or adjusted under 35 U.S.C. 154(b) by 0 days.

(21) Appl. No.: 16/013,564

(22) Filed: Jun. 20, 2018

(65) Prior Publication Data

US 2018/0363299 A1 Dec. 20, 2018

Related U.S. Application Data

(60) Provisional application No. 62/522,302, filed on Jun. 20, 2017.

(51) Int. Cl.
*E04C 3/46* (2006.01)

(52) U.S. Cl.
CPC ..... *E04C 3/46* (2013.01)

(58) Field of Classification Search
CPC ..... E04C 3/46
USPC ..... 52/86
See application file for complete search history.

(56) References Cited

U.S. PATENT DOCUMENTS 3,378,965 A * 4/1968 Broquist ..... E04C 3/44 52/88
4,560,523 A 12/1985 Plumley et al.
4,907,383 A 3/1990 Winter, IV
5,671,572 A * 9/1997 Siller-Franco ..... E01D 22/00 29/897.34
6,123,485 A 9/2000 Mirmiran et al.
6,145,270 A 11/2000 Hillman
6,189,286 B1 2/2001 Seible et al.
7,287,358 B2 * 10/2007 Zambelli ..... E04B 1/21 52/223.13
7,562,499 B2 7/2009 Hillman
7,699,270 B2 * 4/2010 Lonsinger ..... B64C 3/185 244/219
7,744,316 B2 6/2010 Kaufman
7,895,799 B2 3/2011 Hillman et al.
8,141,307 B2 3/2012 Hillman et al.
8,935,888 B2 1/2015 Dagher et al.
9,506,214 B1 11/2016 Kaufman et al.
2003/0182883 A1 * 10/2003 Won ..... E01D 2/02 52/223.8
2014/0027538 A1 * 1/2014 Webster ..... F02K 1/06 239/265.43
2014/0283473 A1 * 9/2014 Yoo ..... E04C 3/29 52/309.15
2016/0375977 A1 * 12/2016 Siers ..... B64C 1/06 244/129.1

* cited by examiner

*Primary Examiner* — Beth A Stephan
(74) *Attorney, Agent, or Firm* — Thomas C. Saitta

(57) ABSTRACT

A structural arch having one or more elongated tension members disposed within a shell or core at or near the lowermost edge of the arch, and one or more elongated compression members disposed within the shell or core at or near the uppermost edge of the shell. The core of the arch may be hollow, or optionally, lightweight filler material or filler members may occupy the core.

24 Claims, 6 Drawing Sheets

(A–A)

ARCH HAVING AN INTERNAL TENSION MEMBER

This application claims the benefit of U.S. Provisional Patent Application Ser. No. 62/522,302, filed Jun. 20, 2017.

BACKGROUND OF THE INVENTION

This application relates generally to the field of structural, non-linear, arched beams (referred to herein as arches), and more particularly to such arches which are composite arches comprising a tension member or both compression and tension members.

Structural arches have been in use for thousands of years. Early arches were masonry arches and therefore very heavy and requiring extensive foundation support. The load placed on the arch translated from a vertical force to a horizontal outward force at each arch end, such that it was necessary to provide buttresses or similar structural members to counter these forces. As new materials were developed, such as for example steel and other metals, arch designs that were hybrids or composites evolved. One early type of arch known as a Whipple arch is a tied or bowstring arch, wherein a tension member, such as a metal bar ("the string"), is affixed between the ends of the arch (the "bow") to resist the outward force. Most recently, arch structures incorporate modern synthetic materials having high strength properties, such as for example carbon-fiber reinforced polymers (CFRP) or glass-fiber reinforced polymers (GRFP). While incorporation of these materials may result in a reduction of weight, it has been difficult to balance the utilization of the new materials with the structural requirements of the arch, especially for arches of significant length.

Examples of hybrid arches or beams are shown in U.S. Pat. Nos. 6,145,270 and 7,562,499 to Hillman and in U.S. Pat. Nos. 7,895,799 and 8,141,307 to Hillman and Zicko. Hillman/Zicko show arches or beams wherein tension members in the form of steel rebar are positioned along the bottom of an elongated box member formed of a GRFP, the box having a rigid foam support and several concrete layers. These arches or beams are still very heavy due to the large amount of concrete present in the arch or beam.

It is an object of this invention to provide a structural arch that is significantly lighter and smaller in cross-section than traditional arches, yet still provides excellent strength properties. It is a further object of this invention to provide such arches wherein an elongated tension member and/or compression member is contained within the arch body itself.

SUMMARY OF THE INVENTION

In various embodiments, the invention is a structural arch which may be classified as a composite or hybrid arch, the arch comprising a significant amount of synthetic materials and elements in order to reduce weight while increasing strength. The arch comprises in general an external skin or shell, either extending continuously in the longitudinal direction or discontinuous such as to comprise a plurality of longitudinally spaced bands, one or more elongated tension members disposed within the shell at or near the base of the shell, and possibly one or more elongated compression members disposed within or as part of the shell at or near the top of the shell. The core of the arch may be hollow or may comprise a lightweight filler material, such as for example a rigid foam, or lightweight filler members, such as for example tubular members, occupying the core of the shell. Alternatively, the arch may comprise a solid, homogenous material with the tension and/or compression members embedded within the material. The shell unites the tension and compression members into a composite structure. The shell may be composed of a polymer, a reinforced polymer material, a resin-impregnated fabric, such as a GFRP or a CFRP, or like material. The tension and compression members may be metal rods, such as steel rebar or aluminum rods, rods or plate members made of reinforced polymer material, rolled resin-impregnated fabric, GFRP, CFRP, AFRP rebar, or like material. The filler, if present, may comprise a rigid polymer foam, bundles of polymer tubes, or the like. The arch is preferably configured such that in cross-section transverse to the longitudinal axis the bottom of the arch, and preferably the top of the arch as well, defines a pointed or V-shaped edge, in the case of triangular or diamond-shaped cross-sections, or such that in cross-section transverse to the longitudinal axis there exists a lowermost and upper point, in the case circular or elliptical cross-sections. Thus, the arch is configured to have a nadir and most preferably a nadir and an apex.

DETAILED DESCRIPTION OF THE INVENTION

Figure 1:
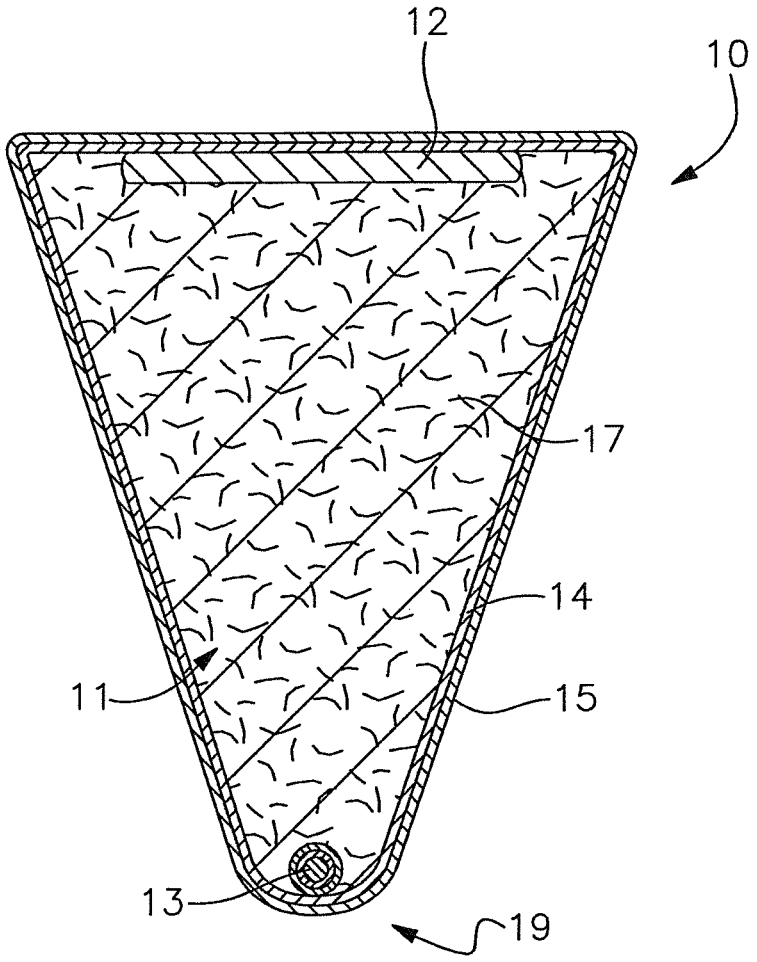
FIG. 1 is cross-sectional view of an embodiment of the invention showing an arch comprising a rigid foam core, a rod tension member beneath the foam core, a fiberglass plate compression member above the foam core, a shell enveloping the foam core, tension member and compression member, and an external resin overcoating.

Various representative embodiments of the invention are shown in the drawings. The figures are intended to provide disclosure but are not intended to limit the scope of the invention.

In a broad and general sense, the invention is a structural arch which may be classified as a composite or hybrid arch, the arch comprising a significant amount of lightweight synthetic materials and elements in order to reduce weight without sacrificing strength. As used herein, the term "lightweight" shall be taken to refer to a weight at least half the weight of an equivalent volume of concrete or steel, and more preferably a weight at least one-fourth the weight of an equivalent volume of concrete or steel. The arch comprises in general an external skin or shell, either continuous or discontinuous in the longitudinal direction, one or more elongated tendons or tension members disposed within the shell at or near the base of the shell, and one or more elongated compression members disposed within or comprising a portion of the shell at or near the top of the shell. The arch is preferably configured such that in cross-section transverse to the longitudinal axis the bottom of the arch, and preferably the top of the arch as well, defines a pointed or V-shaped longitudinal edge, in the case of triangular or diamond-shaped cross-sections, or such that in cross-section transverse to the longitudinal axis there exists a lowermost and upper point, in the case of circular or elliptical cross-sections. Thus, the arch is configured to have a nadir and most preferably a nadir and an apex. Optionally, a filler material or filler members may occupy the core of the shell, serving as a mandrel for forming the shell and/or providing additional strength to the arch. The arch may also be constructed of a solid, lightweight, homogeneous material with the tension and compression members embedded within the material. The shell connects the tension and compression members, thus forming a high strength composite arch structure. The shell may be composed of a polymer, a reinforced polymer material, a resin-impregnated fabric, CFRP, GFRP, or like material. The tension and compression members may be metal rods, such as steel rebar or aluminum rods, rods or plate members made of reinforced polymer material, rolled resin-impregnated fabric, AFRP rebar, or like material. The filler, if present, may comprise rigid polymer foam, bundles of polymer tubes, or the like.

A first embodiment of the invention is shown in FIG. 1. The arch 10 comprises a core 11, a compression member 12, a tension member 13, a shell member 14 and an (optional) overcoat or reinforcing sleeve member 15. The core 11 occupies the majority of the internal volume of the arch 10 and is preferably composed of a rigid yet lightweight material, such as for example a rigid polymer foam. The rigid foam 17 may be a relatively light weight, low density foam so as to serve merely to define the configuration of the shell 14 during the shell 14 wrapping operation, or a high strength, high density foam may be utilized to add strength to the arch 10. As shown in this embodiment the core 11 presents a generally triangular configuration in cross-section, but other configurations such as circular, oval, diamond, etc., may be utilized, wherein the configuration defines a longitudinally extending lowermost edge defining a nadir 19. An elongated compression member 12 is positioned above the core 11, the compression member 12 extending substantially over the full length of the arch 10. The compression member 12 may be composed of various materials and presented in various configurations, such as a fiber-reinforced polymer or resin-impregnated fabric plate member as shown in the drawing, one or more elongated metal rod members, such as steel rebar, one or more rods of fiber-reinforced polymer or rolled, resin-impregnated fabrics, or similar materials and structures possessing the required physical properties. The tension member 13 may comprise one or more elongated metal rods or rods composed of fiber-reinforced polymer, or rolled, resin-impregnated fabrics, one or more cables, or like members. The tension member 13 is disposed within or adjacent the lowermost edge of the arch, at or adjacent the nadir 19 and extends to the ends 16 of the arch 10.

The skin or shell member 14 is a constraining and reinforcing membrane that connects the tension and compression members 12/13 in a unitized manner so as to define the structural composite. The shell 14 prevents shearing and restricts movement of the tension and compression members 12/13. The shell 14 may be presented as a steel-reinforced polyester fabric, a resin-impregnated fabric, fiberglass sheet, a laminate or like sheet member, and is tightly wrapped or wound around the core 11, compression member 12 and tension member 13 in single or multiple layers and allowed to cure into a rigid member. A portion of the shell 14 may be wrapped around the tension member 13 itself to better secure the tension member 13 within the underside of the arch 10. Whereas the compression member 12 is rigidly affixed to the shell 14 of the arch 10, the tension member 13 may be affixed to the arch components and the shell member 14 as shown, in which case it is pre-tensioned and bonded, or may be enclosed within a sheath or tube so as to be free-moving, in which case it is post-tensioned and unbonded, yet secured at the ends 16).

The composite core 11, one or more compression members 12, one or more tension members 13 and shell member 14 may be furthered encased in a resin overcoat or reinforcing sleeve 15 to provide additional structural integrity, environmental protection or other desirable properties to the arch 10, the sleeve 15 being continuous or discontinuous in the longitudinal direction.

Figure 2A:
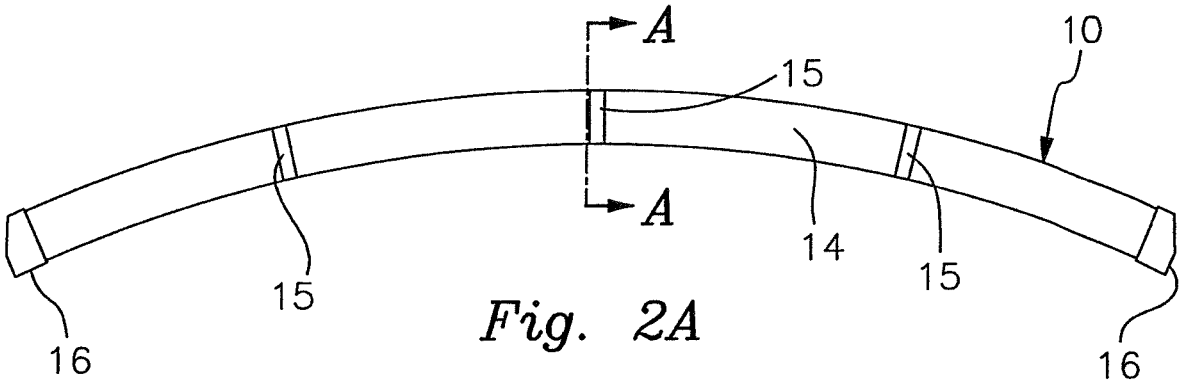
FIGS. 2A, 2B and 2C are views of another embodiment of the arch of the invention wherein the arch body is a hollow shell having spaced reinforcing sleeve members.
Figure 2B:
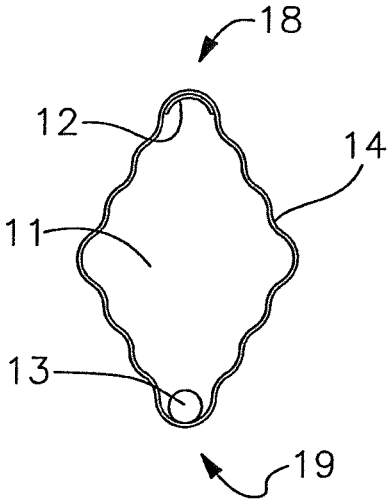
Figure 2C:
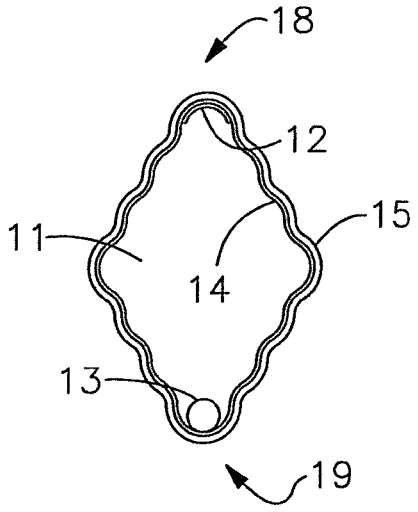

A second embodiment of the invention is shown in FIGS. 2 and 3. In the embodiment of FIG. 2, the arch 10 comprises a hollow core 11, a compression member 12, a tension member 13 and a shell member 14, and is shown in a cross-sectional diamond configuration defining a nadir 19 and an apex 18, the apex 18 being an uppermost longitudinal edge of the arch 10. As before, multiple shapes are possible, including ovals, circles, T's, rectangles, triangles, etc. The compression member 12 may be composed of various materials and presented in various configurations, such as a fiber-reinforced polymer or resin-impregnated fabric plate member as shown in the drawing, one or more elongated metal rod members, such as steel rebar, one or more rods of fiber-reinforced polymer or rolled, resin-impregnated fabrics, or similar materials and structures possessing the required physical properties. The tension member 13 may comprise one or more elongated metal rods or rods composed of fiber-reinforced polymer, or rolled, resin-impregnated fabrics, one or more cables, or like members. The shell 14 may be presented as a steel-reinforced polyester fabric, a resin-impregnated fabric, fiberglass sheet, a laminate or like sheet member. A sacrificial or removable mandrel may be utilized to properly position the tension and compression members 12/13 and to define the final configuration of the shell 14, the shell material being wound about the mandrel in single or multiple layers and allowed to cure into a rigid member.

The arch 10 of FIG. 2 is provided with a discontinuous reinforcing sleeve 15 defining reinforcing bands that encircle the shell 14 at spaced locations and which provide increased strength and integrity to the arch 10. The reinforcing sleeves 15 may be composed of material similar to the shell 14, such as for example a steel-reinforced polyester fabric, a resin-impregnated fabric, fiberglass sheet, a laminate or like sheet member.

Figure 3A:
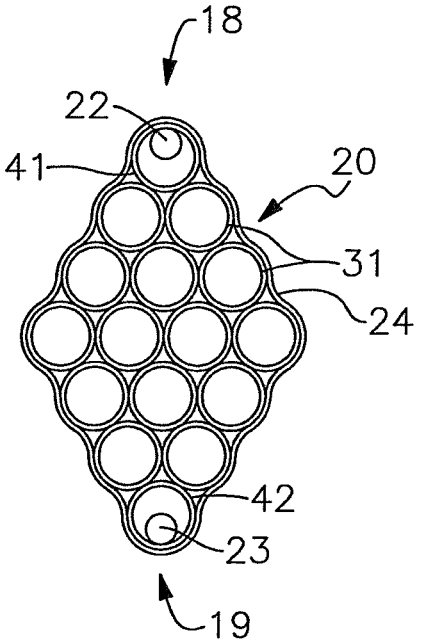
FIGS. 3A and 3B are cross-sectional views of alternate embodiments wherein the core member comprises a plurality of tubular members.
Figure 3B:
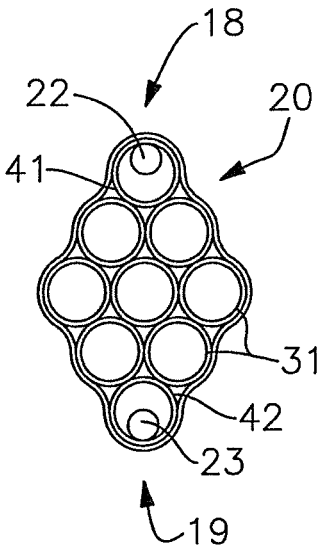

In the embodiment of FIG. 3, the core 21 of arch 20 comprises a plurality of core tubular members 31, which may be composed of PVC, metal or material possessing similar properties. The tubular members 31 are capped or sealed on the ends, wrapped in the shell member 24 or otherwise secured to preclude delamination under load. Most preferably each tubular member 31 is coextensively glued or otherwise bonded to adjacent tubular members 31 to preclude slippage or shear when under load. The uppermost tubular member 31 occupies the apex 18 and is a compression member tube 41 retaining the compression member 22, and the lowermost tubular member occupying the nadir 19 is a tension member tube 42 retaining the tension member 21. In this embodiment, there are more core tubular members 31 at the base or end of the arch 20, as shown in FIG. 3A, than at the middle of the arch 20, as shown in FIG. 3B, some of the core tubular members 31 being truncated such that the volume of the arch 20 is reduced in the middle portion and largest at each end 16. The core tubular members 31 may be of relatively low strength and rigidity and be utilized solely to define the configuration of the shell 14 during the shell wrapping operation, or alternatively the core tubular members 31 may be of relatively high strength and rigidity so as to add strength to the arch 10.

It is also contemplated to position the compression and/or tension members 22/21 externally to the core tubular members 31 at the nadir 19 and apex 18 so as to reside in the valley between adjoining core tubular members 31, the compression and/or tension members 22/21 being secured by the over-wrap of the shell member 24.

Figure 4A:
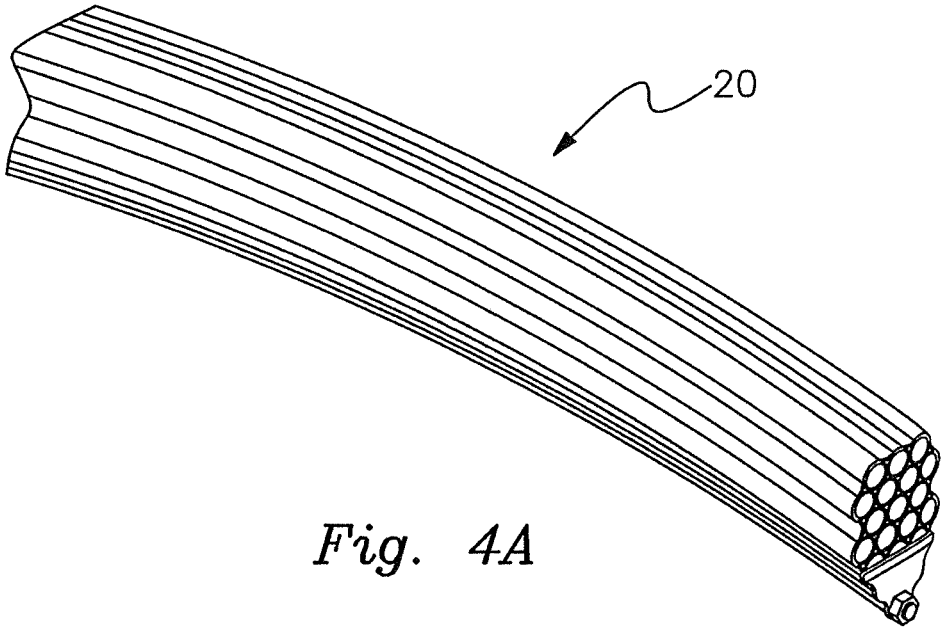
FIGS. 4A and 4B are partial views of another embodiment of the arch illustrating an assembly for post-tensioning the tension member.
Figure 4B:
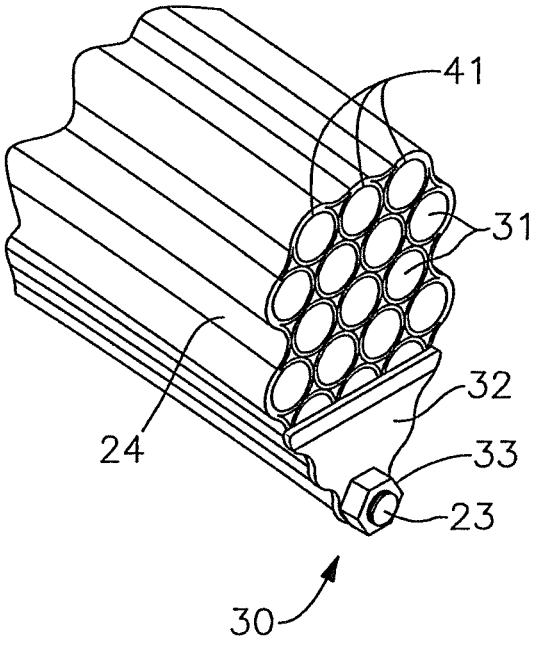
Figure 5:
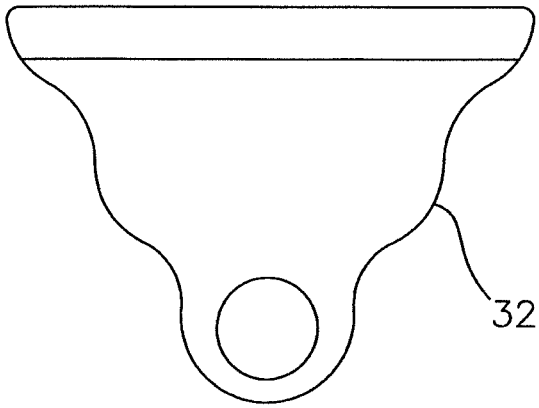
FIG. 5 are views of an embodiment for an end plate suitable for use in the post-tensioning assembly of FIGS. 4A/B.
Figure 6:
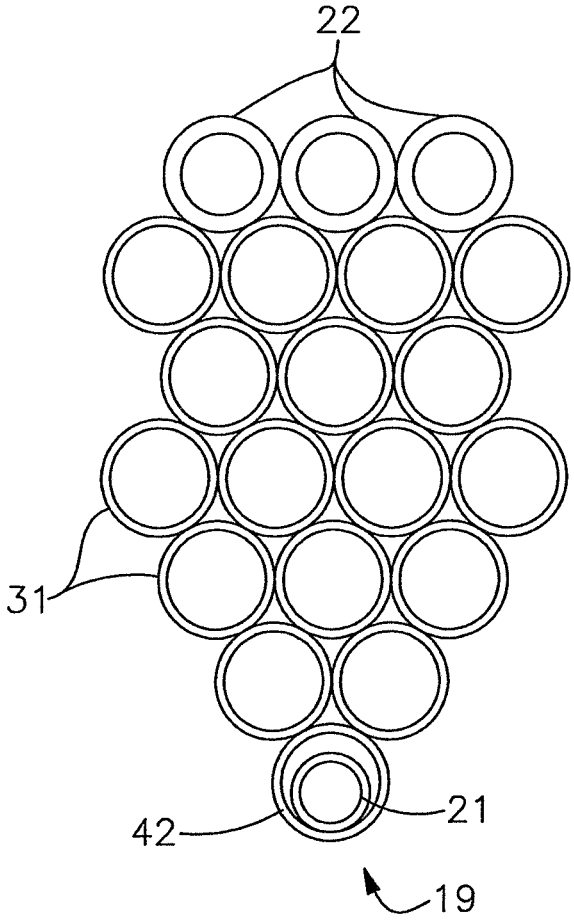
FIG. 6 is a cross-sectional view of another embodiment of the arch showing the compression member being formed of tubular members having relatively thick walls and the tension member positioned within a tubular member.

Another embodiment of the arch 20 is shown in FIGS. 4 and 5, wherein the core tubular members 31 are disposed in alternating rows of different number. A tensioning assembly 30 is provided comprising an elongated tension member 23 adapted for post-tensioning the arch 10, the post-tensioning assembly 30 comprising an end plate 32 that abuts the end of the tensioning member tube 42. The tension member 23 is provided with a threaded end and extends beyond the tensioning member tube 42 and through an aperture in the end plate 32, such that a tightening nut 33 may be threaded on to the tension member 23 and tightened against the end plate 32 to apply tensional force to the tension member 23. In this embodiment and in FIG. 6 the compression member 22 is formed as a combination of tubular members having relatively thick walls so as to be more rigid than the core tubular members 31.

Figure 7:
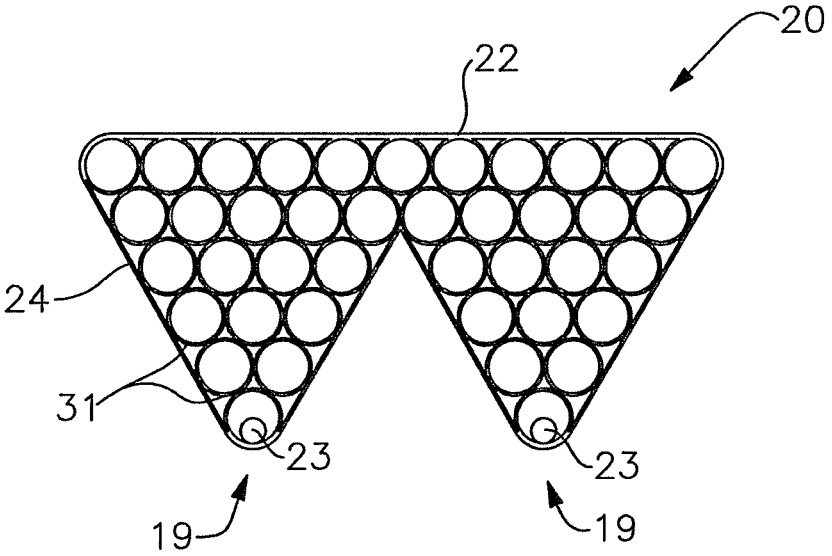
FIG. 7 is a cross-sectional view of another embodiment of the arch showing the compression member formed as a thickened portion of the shell.

FIG. 7 illustrates another embodiment, wherein the arch 20 has a double triangle configuration in cross-section with a tension member 23 at, in or adjacent the nadir 19 of each triangular section. The compression member 22 in this embodiment is formed by a thicker and/or reinforced portion of the shell 24 disposed on the upper portion of the arch 20.

Figure 8:
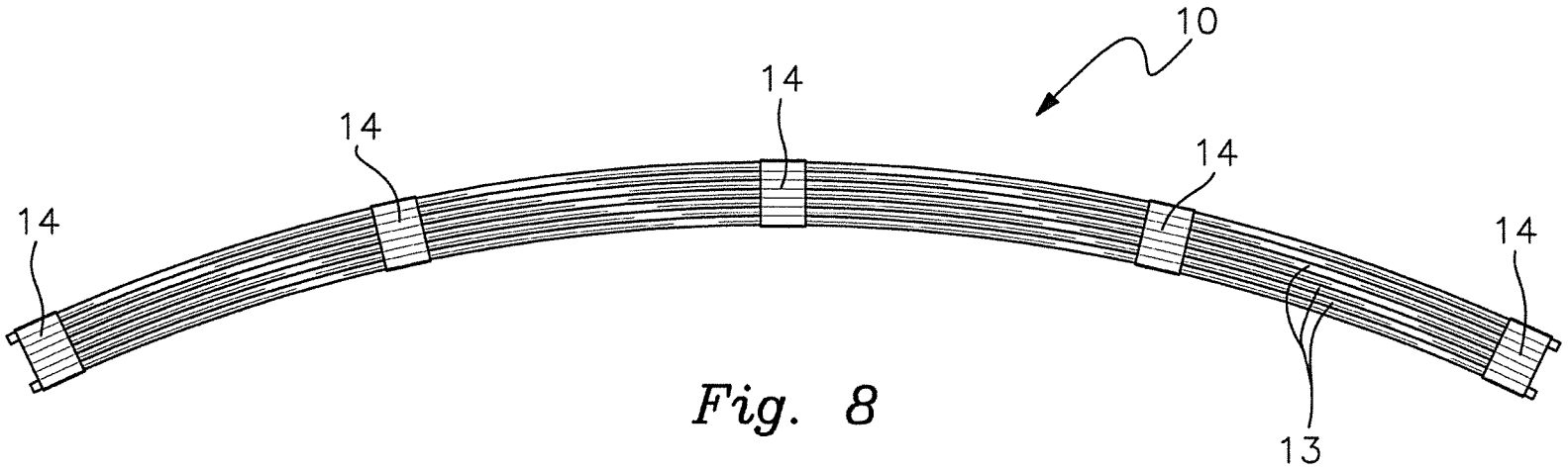
FIG. 8 illustrates another embodiment of the arch wherein the shell is discontinuous in the longitudinal direction whereby the tubular members forming the core are retained by shell bands.

FIG. 8 illustrates another embodiment for the arch 10, wherein the shell member 14 retaining the tubular members 31 is discontinuous in the longitudinal direction, such that the shell member 14 is present in the form of a plurality of bands.

The tension member or members 13/23 and the compression member or members 12/22 may be balanced in strength, or the tension member or members 13/23 and the compression member or members 12/22 may be unbalanced in strength, which will alter the location of the neutral axis. In the embodiments having a hollow core 11, low strength rigid foam 17 or low strength core tubular members 31, the shell member 14 must be of sufficiently high strength to provide structural support for the arch 10, whereas in the embodiments wherein the rigid foam 17 or core tubular members 31 possess high strength and add structural benefit, the shell member 14 may be reduced in thickness or formed of a material with a lower strength.

It is further contemplated that the arch 10 may be constructed of a solid, lightweight, homogeneous material, such as for example rigid polymer foam, without the requirement of a shell 14, wherein the tension members 13 and compression members 14 are embedded within the homogeneous material.

It is understood that equivalents and substitutions for certain elements described above may be obvious to those of ordinary skill in the art, and therefore the true scope and definition of the invention shall be as set forth in the following claims.

We claim:

1. A structural arch having a longitudinal axis, a lowermost longitudinal edge and an uppermost longitudinal edge, said structural arch comprising:

at least one elongated tension member, said arch configured in cross-section transverse to said longitudinal axis such that the lowermost longitudinal edge defines a nadir, and wherein said at least one tension member is disposed at or adjacent said nadir;

at least one elongated compression member, said arch configured in cross-section transverse to said longitudinal axis such that the uppermost longitudinal edge defines an apex, and wherein said at least one compression member is disposed at or adjacent said apex; and a hollow core.

2. The structural arch of claim 1, further comprising a shell.

3. The structural arch of claim 2, wherein said shell is composed of a material chosen from the group of materials consisting of polymers, reinforced polymer materials, resin-impregnated fabrics, carbon-fiber reinforced polymers and glass-fiber reinforced polymers.

4. The structural arch of claim 1, further comprising a tensioning assembly to tighten said at least one tension member.

5. The structural arch of claim 1, wherein said at least one elongated tension member is chosen from the group of elongated tension members consisting of metal rods, steel rebar, aluminum rods, rods made of reinforced polymer material, plate members made of reinforced polymer material, rolled resin-impregnated fabric, and AFRP rebar.

6. The structural arch of claim 5, wherein said at least one elongated compression member is chosen from the group of elongated compression members consisting of metal rods, steel rebar, aluminum rods, rods made of reinforced polymer material, plate members made of reinforced polymer material, rolled resin-impregnated fabric, and AFRP rebar.

7. The structural arch of claim 1, wherein said at least one elongated compression member is chosen from the group of elongated compression members consisting of metal rods, steel rebar, aluminum rods, rods made of reinforced polymer material, plate members made of reinforced polymer material, rolled resin-impregnated fabric, and AFRP rebar.

8. A structural arch having a longitudinal axis, a lowermost longitudinal edge and an uppermost longitudinal edge, said structural arch comprising:

at least one elongated tension member, said arch configured in cross-section transverse to said longitudinal axis such that the lowermost longitudinal edge defines a nadir, and wherein said at least one tension member is disposed at or adjacent said nadir;

at least one elongated compression member, said arch configured in cross-section transverse to said longitudinal axis such that the uppermost longitudinal edge defines an apex, and wherein said at least one compression member is disposed at or adjacent said apex; and a core, wherein said core comprises a plurality of tubular members.

9. The structural arch of claim 8, further comprising a shell.

10. The structural arch of claim 9, wherein said shell is composed of a material chosen from the group of materials consisting of polymers, reinforced polymer materials, resin-impregnated fabrics, carbon-fiber reinforced polymers and glass-fiber reinforced polymers.

11. The structural arch of claim 8, wherein said plurality of tubular members are coextensively bonded together.

12. The structural arch of claim 8, further comprising a tensioning assembly to tighten said at least one tension member.

13. The structural arch of claim 8, wherein said at least one elongated tension member is chosen from the group of elongated tension members consisting of metal rods, steel rebar, aluminum rods, rods made of reinforced polymer material, plate members made of reinforced polymer material, rolled resin-impregnated fabric, and AFRP rebar.

14. The structural arch of claim 13, wherein said at least one elongated compression member is chosen from the group of elongated compression members consisting of metal rods, steel rebar, aluminum rods, rods made of reinforced polymer material, or plate members made of reinforced polymer material, rolled resin-impregnated fabric, and AFRP rebar.

15. The structural arch of claim 8, wherein said at least one elongated compression member is chosen from the group of elongated compression members consisting of metal rods, steel rebar, aluminum rods, rods made of reinforced polymer material, plate members made of reinforced polymer material, rolled resin-impregnated fabric, and AFRP rebar.

16. A structural arch having a longitudinal axis, a lowermost longitudinal edge and an uppermost longitudinal edge, said structural arch comprising:

at least one elongated tension member, said arch configured in cross-section transverse to said longitudinal axis such that the lowermost longitudinal edge defines a nadir, and wherein said at least one tension member is disposed at or adjacent said nadir;

further comprising at least one elongated compression member, said arch configured in cross-section transverse to said longitudinal axis such that the uppermost longitudinal edge defines an apex, and wherein said at least one compression member is disposed at or adjacent said apex; and further comprising a tensioning assembly to tighten said at least one tension member.

17. The structural arch of claim 16, further comprising a shell.

18. The structural arch of claim 16, wherein said at least one elongated tension member is chosen from the group of elongated tension members consisting of metal rods, steel rebar, aluminum rods, rods made of reinforced polymer material, or plate members made of reinforced polymer material, rolled resin-impregnated fabric, and AFRP rebar.

19. The structural arch of claim 16, wherein said at least one elongated compression member is chosen from the group of elongated compression members consisting of metal rods, steel rebar, aluminum rods, rods made of reinforced polymer material, or plate members made of reinforced polymer material, rolled resin-impregnated fabric, and AFRP rebar.

20. A structural arch having a longitudinal axis, a lowermost longitudinal edge and an uppermost longitudinal edge, said structural arch comprising:

at least one elongated tension member, said arch configured in cross-section transverse to said longitudinal axis such that the lowermost longitudinal edge defines a nadir, and wherein said tension member is disposed at or adjacent said nadir;

at least one elongated compression member, said arch configured in cross-section transverse to said longitudinal axis such that the uppermost longitudinal edge defines an apex, and wherein said compression member is disposed at or adjacent said apex; and a core composed of a rigid polymer foam;

wherein the lowermost longitudinal edge is pointed or V-shaped in cross-section transverse to the longitudinal axis.

21. The structural arch of claim 20, wherein the uppermost longitudinal edge is pointed or V-shaped in cross-section transverse to the longitudinal axis.

22. The structural arch of claim 21, wherein said at least one elongated tension member is chosen from the group of elongated tension members consisting of metal rods, steel rebar, aluminum rods, rods made of reinforced polymer material, plate members made of reinforced polymer material, rolled resin-impregnated fabric, and AFRP rebar.

23. The structural arch of claim 20, wherein said at least one elongated tension member is chosen from the group of elongated tension members consisting of metal rods, steel rebar, aluminum rods, rods made of reinforced polymer material, plate members made of reinforced polymer material, rolled resin-impregnated fabric, and AFRP rebar.

24. The structural arch of claim 20, further comprising a tensioning assembly to tighten said at least one tension member.

* * * * *